United States Patent [19]

Adair

[11] 4,044,895

[45] Aug. 30, 1977

[54] PIPE RACKING SYSTEM

[75] Inventor: Lewell Seidell Adair, Fort Smith, Ark.

[73] Assignee: Barney Silis Adams, Jr., Fort Smith, Ark.

[21] Appl. No.: 692,785

[22] Filed: June 4, 1976

[51] Int. Cl.[2] ..... E21B 19/00

[52] U.S. Cl. ..... 214/2.5; 175/5; 175/85; 214/1 P

[58] Field of Search ..... 214/2.5, 1 P, 1 PB; 175/52, 85, 5, 7

[56] References Cited

U.S. PATENT DOCUMENTS

| | | | |
|---|---|---|---|
| 2,690,847 | 10/1954 | Crookston | 214/2.5 |
| 3,513,996 | 5/1970 | Woolslayer | 214/1 P X |

*Primary Examiner*—Frank E. Werner
*Assistant Examiner*—George F. Abraham
*Attorney, Agent, or Firm*—Dennison, Dennison, Meserole & Pollack

[57] ABSTRACT

A vertically elongated container for drill pipe depends from and opens upwardly through the drilling platform of an offshore drilling rig in closely spaced relation to the rotary table. A power controlled pivotally mounted chute is associated with the container and selectively moves between a first position inclined toward the rotary table for the introduction and removal of pipe to and from the container by the derrick apparatus, and a substantially vertical position within the container for cooperation with handling apparatus utilized to manipulate the pipe within the container.

5 Claims, 3 Drawing Figures

PIPE RACKING SYSTEM

The present invention generally relates to a pipe racking system, and is more particularly concerned with the racking of drill pipe or pipe sections at offshore drilling sites wherein floating or stationary drilling platforms are utilized.

The pipe or pipe sections utilized in formation of the drill stem usually comes in lengths of 30 to 32 feet and have heretofore, for the most part, been racked above the rig floor with the storage of the pipe normally being up from the platform and into the derrick structure for support by a pipe racking fingerboard having finger latch mechanisms, as for example shown in U.S. Pat. No 3,799,364. Such an arrangement normally requires that a member of the drilling crew be stationed up in the derrick so as to assist in guiding and racking the pipe. This is considered quite hazardous and many injuries and fatalities have been known to occur, particularly in bad weather.

Some of the problems associated with above floor racking of the pipe, which also include a tendency to make the overall apparatus somewhat unstable, particularly when dealing with a floating platform, have been avoided by a below floor racking as suggested in U.S. Pat. No. 3,339,747.

The present invention is particularly concerned with the provision of means for facilitating and substantially improving the manner in which drill pipe is introduced to and removed from a below the floor container. Basically, the invention involves a power manipulated chute which can be adjusted at an inclination toward the drill string so as to facilitate the introduction and removal of pipe by the drill string manipulating apparatus controlled by the draw works. The chute is in turn selectively pivoted to a substantially vertical position within the container for the reception or discharge of pipe in conjunction with a powered manipulating arm capable of grasping the pipe and shifting the pipe between the pipe racking finger assembly within the container and the pipe aligning chute. In order to enable an orientation of the upper end of the chute as close as possible to the rotary table, the platform itself, between the container and the rotary table, is provided with a section which is removed during the pipe unloading or loading periods, and which is replaced so as to provide for a complete working surface at all other times.

Attention is directed to the following patents which further set forth the general state of the art as it is presently known:

U.S. Pat. No. 3,456,745—Peri
U.S. Pat. No. 3,768,663—Turner, Jr., et al
U.S. Pat. No. 3,828,943—Simon
U.S. Pat. No. 3,877,583—Bokenkamp
U.S. Pat. No. 3,895,677—Bokenkamp Various additional objects and advantages of the invention are considered to reside in the details of construction and operation as more fully hereinafter described and claimed. Reference is had to the accompanying drawings forming a part hereof wherein like numerals refer to like parts throughout, and in which:

Figure 1:
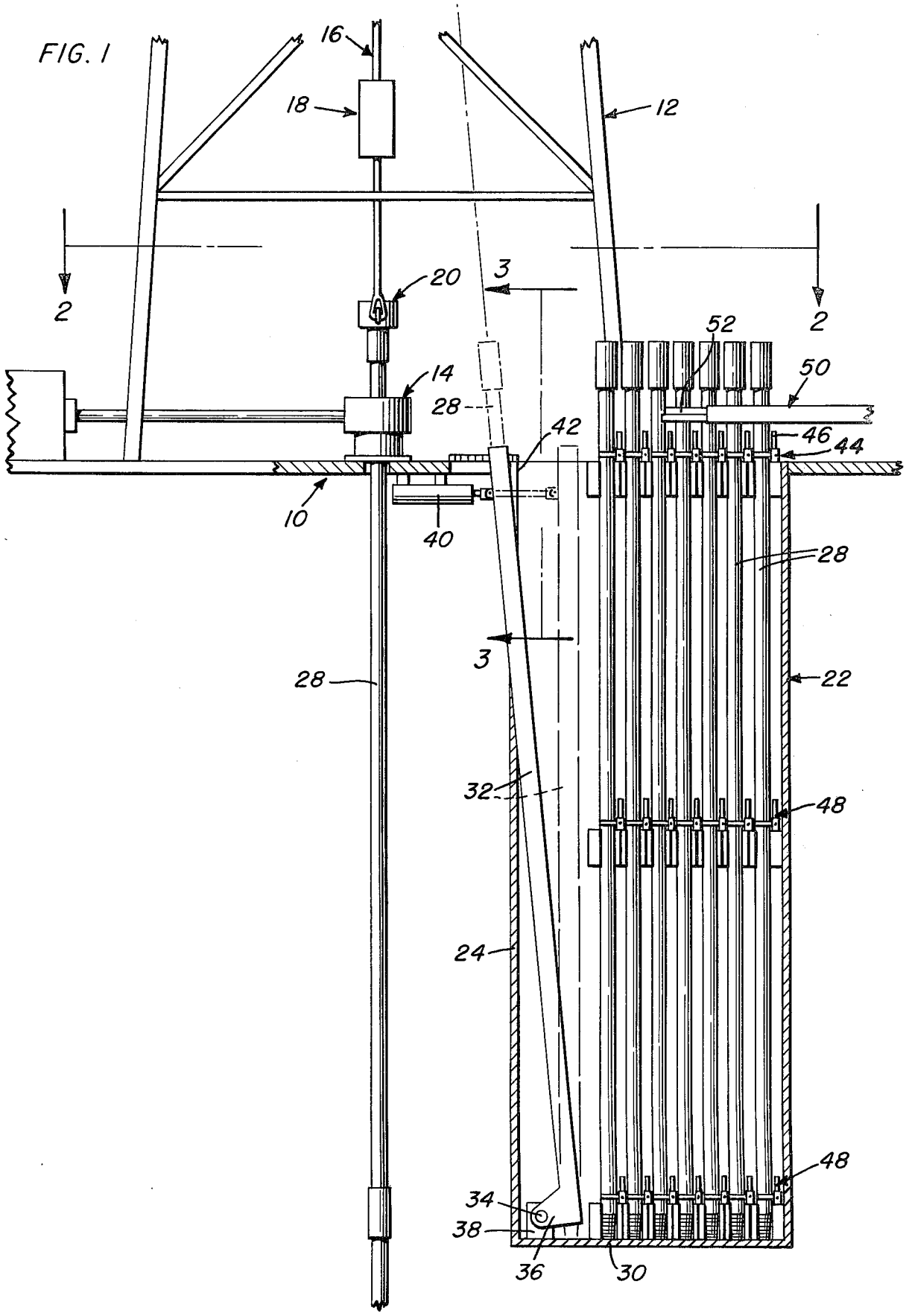
FIG. 1 is a side elevational view, with portions broken away, of a drilling platform, derrick and the racking container structure of the present invention.
Figure 2:
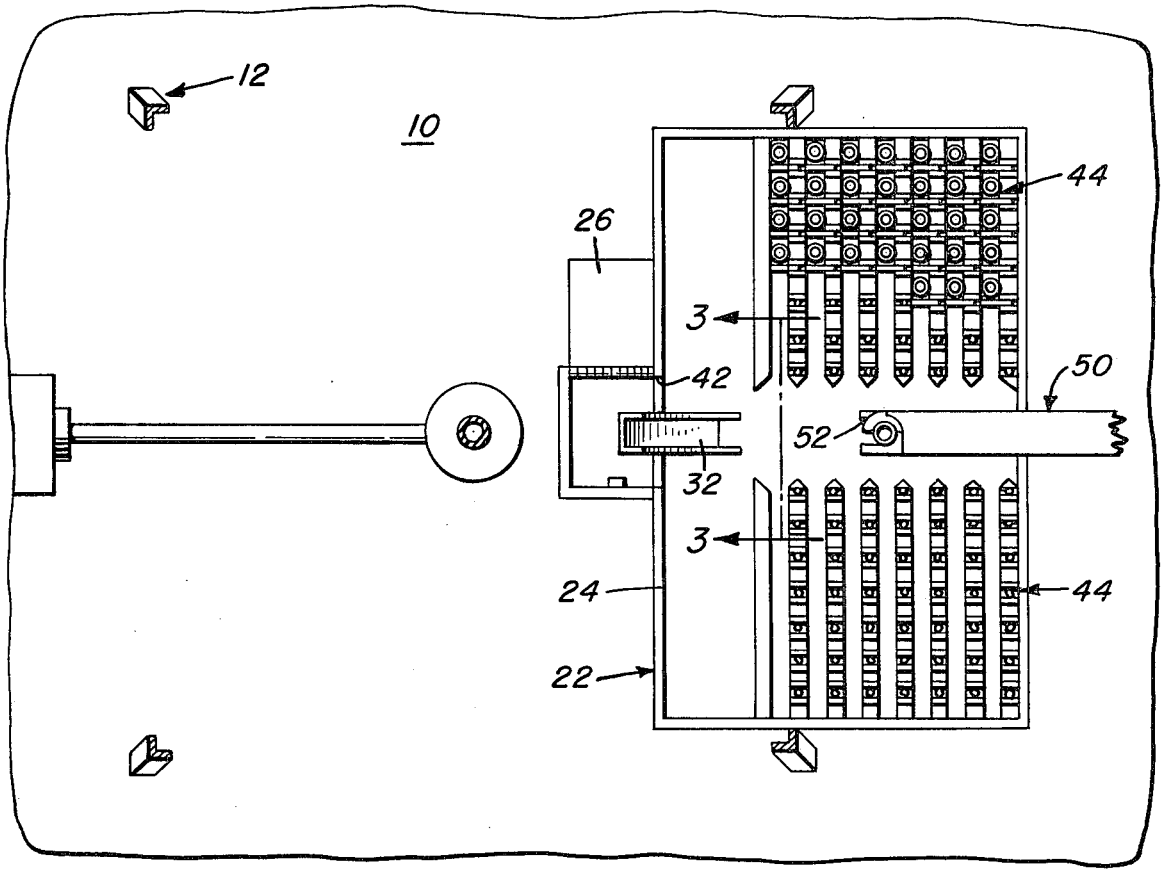
FIG. 2 is a top plan view taken substantially on a plane passing along line 2—2 of FIG. 1.
Figure 3:
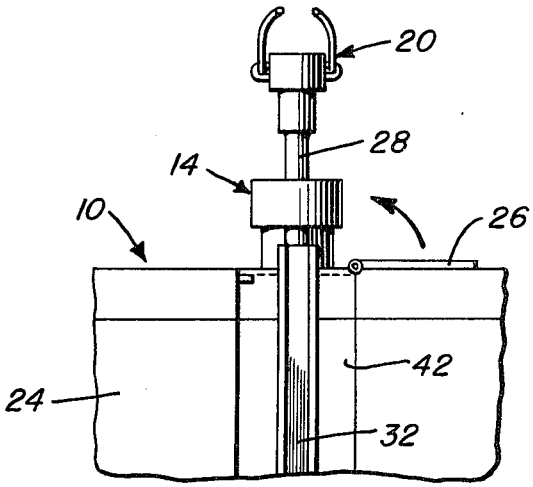
FIG. 3 is a cross-sectional detail taken substantially on a plane passing along line 3—3 of FIG. 1.

Referring now more specifically to the drawings, reference numeral 10 is used to generally designate an offshore platform, either floating or stationary, which mounts a conventional drilling derrick 12 positioned over a rotary table 14. The derrick in turn mounts the conventional string handling apparatus 16 which includes, under the control of appropriate draw works, traveling mounted block assembly 18 and elevators 20.

As indicated, the present invention contemplates the storage of the drill pipe, pipe sections, or the like vertically below the platform 10 in a vertically orientated container or compartment 22. This container 22, of either solid or open wall construction, is rigidly affixed to the platform structure in any appropriate manner and depends vertically therefrom. The upper end of the container 22 opens through the platform 10 with this open upper end being substantially coplanar with the upper surface of the platform. The container, while positioned in closely spaced relation to the rotary table 14, must of necessity have the near wall 24 thereof positioned a sufficient distance from the rotary table 14 so as to provide for a full work area about the rotary table 14 and in particular between the rotary table 14 and the container 22. However, and as shall be explained in more detail subsequently, a portion of the platform floor, outward of the wall 24, is in the nature of a movable or removable panel 26 for a facilitation of a movement of the pipe or pipe sections 28 between the drill string and the container 22.

The container 22 includes a flat bottom or base 30. A vertically elongated chute 32 is positioned within the container 22 just inward of the near wall 24 and in alignment with the rotary table 14. The lower end portion of the chute 32 is pivotally affixed to the bottom 30, for example by means of a pivot pin 34 extending through rearwardly projecting ears 36 on the chute 32 and through a base mounted block 38 received between the ears 36. This chute 32 is of a heighth whereby the upper end thereof is substantially at or slightly above the open upper end of the container 22. Pivotal adjustment of the chute 32 is effected by means of a double acting hydraulic actuator affixed below the surface of the platform 10 outward of the removable panel 26 and in general alignment between the rotary table 14 and the upper end of the chute 32 with the piston of the actuator 40 appropriately engaged with the outer face of the chute 32.

The chute 32 is to be movable between two positions, a first substantially vertically orientated position within the container 22 and a second position inclined through a vertically elongated opening or slot 42 in the near wall 24 with the upper portion of the chute angled toward the string handling apparatus 16 and directly accessible through the platform opening defined by the removal of panel 26. It is contemplated that the wall opening 42 extend downward from the upper end thereof a distance sufficient so as to accommodate the maximum contemplated angular orientation of the chute 32.

A pipe racking fingerboard arrangement 44, with adjustable latching fingers 46, is provided at the upper end of the container 22 to both sides of the chute 32 for the storage of pipe. Additional fingerboards or plain dividers 48, aligned with the racking finger board 44, can be provided along the bottom 30 and at an intermediate heighth within the container 24 for cooperation with the racking finger assembly 44 if so desired. In addition, pipe handling apparatus 50, schematically illustrated, is provided within or slightly above the container 22 for a selective transfer of the pipe between the chute and the racking finger assembly. The pipe handling apparatus can be of any conventional construction incorporating a gripping head 52 on the outer end thereof and appropriate mechanical or hydraulic actuators for effecting the necessary transfer of the pipe within the container 22.

Within the container 22, the actual transfer of the pipe to and from the chute 32 is effected with the chute 32 vertically orientated for cooperation with the handling apparatus 50, and more particularly the pipe gripping head 52. When the pipe is to be transferred to or from the derrick mounted drill string, the chute 32 is inclined for general alignment therewith, at which time the panel 26 is maintained open.

In operation, dismantling of the drill string and a storage of the pipe can be easily effected utilizing the drill string handling apparatus 16 itself. The block assembly 18 is lowered by the draw works until elevators 20 latch on to the pipe 28 in the rotary table 14. The block assembly 18 is then raised so as to extract the pipe to the desired length, that is anywhere from one to three sections, after which the slips are set and the pipe is unscrewed. Next, either manually or utilizing mechanical manipulation apparatus associated with the string handling apparatus, the pipe 28 is swung over to the upper end of the inclined chute 32 accessible through the opening defined by the removable panel. Upon alignment of the lower end of the pipe or multiple joined sections, the pipe is lowered down the inclined chute to the bottom 30 of the container 22. The elevators 20 are then unlatched and returned to their original position for the removal of subsequent pipe sections. At the same time, the hydraulic actuator 40 moves the chute to a vertical position whereat the pipe handling apparatus 50 engages the pipe for the selective racking thereof within the container 22. Once the pipe is engaged by the pipe handling apparatus 50, the chute is returned to its inclined position for reception of the next pipe section.

When mounting the pipe on the drill string, the above operation is substantially reversed. Basically, the handling apparatus 50 removes the pipe 28, one section at a time, from the pipe racking finger assembly with each section being introduced into the substantially vertical chute 32 and maintained therein until the chute 32 is inclined sufficiently so as to completely support the section. The panel 26 is opened so as to allow for the full inclination of the chute. Subsequent to the inclination of the chute, the elevators are latched on to the pipe and the pipe extracted, positioned over the rotary table 14 and lowered into the hole. The slips are then set and the pipe released. As will be appreciated, once the pipe is transferred to the chute 32, the pipe handling apparatus 50 is free so as to immediately return for another pipe section 28. By the same token, once the string handling assembly extracts the pipe from the chute 32, the chute can be repositioned vertically so as to receive another section. In this manner, it will be appreciated that a smooth continuous and relatively high speed operation is achieved with all of the transfer components continually operating within a relatively small range of movement to effect the transfer of the pipe, either to or from the drill string, with no difficulty, with little additional or complex equipment, and in a manner particularly adapted for the normally difficult conditions encountered in off-shore operations. Where deemed appropriate, a cover can be placed over the open upper end of the container 22 or a safety barricade can be positioned thereabout.

From the foregoing, it will be recognized that the invention herein constitutes a significant advance in the art of providing for the readily accessible storage of drill string pipe sections at offshore drilling sites. The utilization of the power controlled chute is of particular significance in facilitating the transfer of the pipe between the drill string and the relatively closely spaced container through a utilization of the drill string handling apparatus itself, thus avoiding much of the manipulation apparatus heretofore required.

The foregoing is considered illustrative of the principles of the invention. Further, since modifications and changes may occur to those skilled in the art, it is not desired to limit the invention to the exact contruction and operation shown and described. Accordingly, all suitable modifications and equivalents may be resorted to, falling within the scope of the invention as claimed.

What is claimed as new is:

1. A pipe rack system for well drilling apparatus including a platform with a rotary table in operative position thereon and a drilling derrick rising thereover, said pipe rack system comprising a vertically elongated pipe container rigid with and depending from said platform in closely spaced relation to the rotary table, said container opening upwardly through said platform, said container having a base and peripheral walls including a near wall between the container and the rotary table, a pipe rack within said container, pipe handling means operative for a manipulation of pipe within said container, a pipe chute positioned within said container adjacent said near wall for receiving and supporting pipe along the length thereof, said pipe chute being movable between a first substantially vertical position orientating chute-received pipe substantially vertically and in cooperative relationship with the pipe handling means, and a second position inclined toward the rotary table for selective reception of pipe into or discharge of pipe from the container, said chute having a lower end and an upper end, means pivotally mounting the lower end of the chute inward of said near wall, and power means engaged with the chute adjacent the upper end thereof for a pivotal movement of the chute about the lower end between said first substantially vertical position for orientation of pipe in cooperative relationship with the pipe handling means and said second position inclined toward the rotary table for selective reception or discharge of pipe.

2. The system of claim 1 wherein said near wall includes an opening therein extending downward from the upper end thereof in alignment with the upper portion of the chute, said chute, in the second position thereof, extending through said opening into close proximity to the rotary table.

3. The system of claim 2 wherein said opening is of a size so as to closely receive said chute.

4. The system of claim 3 wherein said platform, outward of said wall and in alignment with the wall opening, includes a removable section so as to selectively expose the upper end of the chute in the second position thereof and provide a complete working surface when the chute is in the first position thereof.

5. The system of claim 2 wherein said platform, outward of said wall and in alignment with the wall opening, includes a removable section so as to selectively expose the upper end of the chute in the second position thereof and provide a complete working surface when the chute is in the first position thereof.

* * * * *